US010758436B2

(12) United States Patent
Hancock et al.

(10) Patent No.: US 10,758,436 B2
(45) Date of Patent: Sep. 1, 2020

(54) POWERED WHEELCHAIR, WHEELCHAIR POWERING DEVICE AND METHOD

(71) Applicant: Inventit Products Inc., Grantsville, UT (US)

(72) Inventors: Brian Hancock, Grantsville, UT (US); Daniel Reuben Haupt, Milwaukee, WI (US); Brett Stone, Magna, UT (US); Dustin Tingey, College Station, TX (US)

(73) Assignee: Inventit Products Inc., Grantsville, UT (US)

( * ) Notice: Subject to any disclaimer, the term of this patent is extended or adjusted under 35 U.S.C. 154(b) by 0 days.

(21) Appl. No.: 16/456,899

(22) Filed: Jun. 28, 2019

(65) Prior Publication Data

US 2019/0321245 A1 Oct. 24, 2019

Related U.S. Application Data

(63) Continuation of application No. 15/942,866, filed on Apr. 2, 2018, now Pat. No. 10,335,331.

(60) Provisional application No. 62/480,008, filed on Mar. 31, 2017.

(51) Int. Cl.

| | |
|---|---|
| ***A61G 5/08*** | (2006.01) |
| ***A61G 5/04*** | (2013.01) |
| ***A61G 5/02*** | (2006.01) |

(52) U.S. Cl.

CPC ..... *A61G 5/047* (2013.01); *A61G 5/02* (2013.01); *A61G 5/048* (2016.11); *A61G 5/08* (2013.01); *A61G 5/0825* (2016.11)

(58) Field of Classification Search

CPC ..... A61G 5/021–022; A61G 5/048; A61G 5/08–0891

See application file for complete search history.

(56) References Cited

U.S. PATENT DOCUMENTS

| | | | | |
|---|---|---|---|---|
| 2,798,565 | A | 7/1957 | Rosenthanl et al. | |
| 3,770,073 | A | 11/1973 | Meyer | |
| 4,037,676 | A | 7/1977 | Ruse | |
| 4,339,013 | A * | 7/1982 | Weigt | A61G 5/006 180/6.5 |
| 4,422,515 | A | 12/1983 | Loveless | |
| 4,652,026 | A | 3/1987 | Byrge | |
| 4,759,418 | A * | 7/1988 | Goldenfeld | A61G 5/047 180/65.1 |
| 4,805,711 | A | 2/1989 | Lautzenhiser | |
| 4,865,344 | A * | 9/1989 | Romero, Sr. | A61G 5/023 280/255 |
| 4,961,473 | A | 10/1990 | Jones | |
| 5,078,227 | A * | 1/1992 | Becker | A61G 5/045 180/221 |

(Continued)

*Primary Examiner* — Erez Gurari
(74) *Attorney, Agent, or Firm* — Workman Nydegger

(57) ABSTRACT

The present disclosure describes devices and systems that can be integrated with a foldable, manual wheelchair to convert the wheelchair into a hybrid chair capable of both manual operation and motor-powered operation. A wheelchair powering device includes a motor that is operatively coupled to a roller member so that rotation of the motor shaft causes rotation of the roller member. The roller member may be engaged against a tire of the wheelchair so that rotation of the roller member causes rotation of the tire via friction between the roller member and tire.

20 Claims, 9 Drawing Sheets

(56) References Cited

U.S. PATENT DOCUMENTS

| | | | | |
|---|---|---|---|---|
| 5,197,559 | A | 3/1993 | Garin, III et al. | |
| 5,495,904 | A | 3/1996 | Zwaan et al. | |
| 5,542,690 | A | 8/1996 | Kozicki | |
| 5,873,425 | A | 2/1999 | Yang | |
| 6,112,837 | A | 9/2000 | Kanno et al. | |
| 6,702,051 | B2 * | 3/2004 | Chu | A61G 5/047 180/13 |
| 6,729,422 | B2 * | 5/2004 | Chu | A61G 5/047 180/13 |
| 7,581,604 | B2 | 9/2009 | Torita | |
| 7,780,179 | B2 | 8/2010 | Brown | |
| 8,016,310 | B2 | 9/2011 | Kylstra et al. | |
| 8,413,749 | B2 * | 4/2013 | Hsu | A61G 5/045 180/65.51 |
| 9,615,982 | B2 | 4/2017 | Richter | |
| 9,687,397 | B1 | 6/2017 | Lin | |
| 2002/0153691 | A1 * | 10/2002 | Liao | A61G 5/023 280/250.1 |
| 2003/0089537 | A1 | 5/2003 | Sinclair et al. | |
| 2010/0193278 | A1 | 8/2010 | Husted et al. | |
| 2010/0200311 | A1 | 8/2010 | Huang et al. | |
| 2013/0008732 | A1 * | 1/2013 | Richter | A61G 5/047 180/167 |
| 2014/0232085 | A1 | 8/2014 | Hsiao-Wecksler et al. | |
| 2018/0280213 | A1 | 10/2018 | Hancock et al. | |

* cited by examiner

POWERED WHEELCHAIR, WHEELCHAIR POWERING DEVICE AND METHOD

CROSS-REFERENCE TO RELATED APPLICATIONS

This application is a continuation of U.S. patent application Ser. No. 15/942,866, filed on Apr. 2, 2018 and titled "POWERED WHEELCHAIR, WHEELCHAIR POWERING DEVICE AND METHOD," which claims priority to and the benefit of U.S. Provisional Patent Application No. 62/480,008, filed on Mar. 31, 2017 and titled "POWERED WHEELCHAIR, WHEELCHAIR POWERING DEVICE AND METHOD," the entirety of each of which is incorporated herein by this reference.

BACKGROUND

Wheelchairs are available in a variety of different forms. One of the most basic distinctions is between "powerchairs," which are wheelchairs powered by batteries and electric motors, and manual wheelchairs, which are self-propelled by the wheelchair user or by an attendant pushing the chair from behind. Many manual wheelchairs are designed to be foldable so that the owner/user can reduce the profile of the wheelchair for easier storage, transport, and/or maneuvering of the wheelchair. For example, a user may fold a wheelchair so it can be placed in the trunk of a car, in a closet, or in another convenient storage location.

Powerchairs incorporate batteries and electric motors to provide propulsion to the wheelchair. Although powerchairs provide motorized assistance to the chair user, they are typically much heavier than their manual chair counterparts, which makes them much more difficult to transport, store, or carry/maneuver. In addition, powerchairs are typically larger than manual wheelchairs and have no folding capabilities, which exacerbates the challenges in storing, transporting, and carrying/maneuvering the powerchairs.

BRIEF SUMMARY

The present disclosure describes devices and systems for upgrading a manual wheelchair to a hybrid wheelchair selectively capable of both manual operation and motor-powered operation. In certain embodiments, a wheelchair upgrade device may be integrated with a standard foldable manual wheelchair with limited alterations required for the manual wheelchair. In certain embodiments, a wheelchair upgrade device is configured so that when coupled to a foldable manual wheelchair, the foldable manual wheelchair maintains its ability to fold down for easier storage, stowing, and/or transport. This enables the selective bimodal use of the wheelchair without reducing the beneficial folding capabilities of the wheelchair. In addition, the wheelchair upgrade device is lightweight, with minimal impact on the ability to store, transport, and/or maneuver the upgraded wheelchair after attachment to the wheelchair upgrade device.

Additional features and advantages will be set forth in part in the description that follows, and in part will be obvious from the description, or may be learned by practice of the embodiments disclosed herein. The objects and advantages of the embodiments disclosed herein will be realized and attained by means of the elements and combinations particularly pointed out in the appended claims. It is to be understood that both the foregoing brief summary and the following detailed description are exemplary and explanatory only and are not restrictive of the embodiments disclosed herein or as claimed.

BRIEF DESCRIPTION OF THE DRAWINGS

In order to describe various features and concepts of the present disclosure, a more particular description of certain subject matter will be rendered by reference to specific embodiments which are illustrated in the appended drawings. Understanding that these figures depict just some example embodiments and are not to be considered to be limiting in scope, various embodiments will be described and explained with additional specificity and detail through the use of the accompanying drawings in which.

DETAILED DESCRIPTION

The present disclosure describes devices and systems for upgrading a manual wheelchair into a hybrid wheelchair selectively capable of both manual operation and motor-powered operation. In certain implementations where the upgraded wheelchair is a foldable wheelchair, the wheelchair upgrade device is configured to beneficially maintain the folding capabilities of the wheelchair, so that the wheelchair continues to provide relatively easy storage, transport, and/or maneuvering, even after upgrading.

Figure 1:
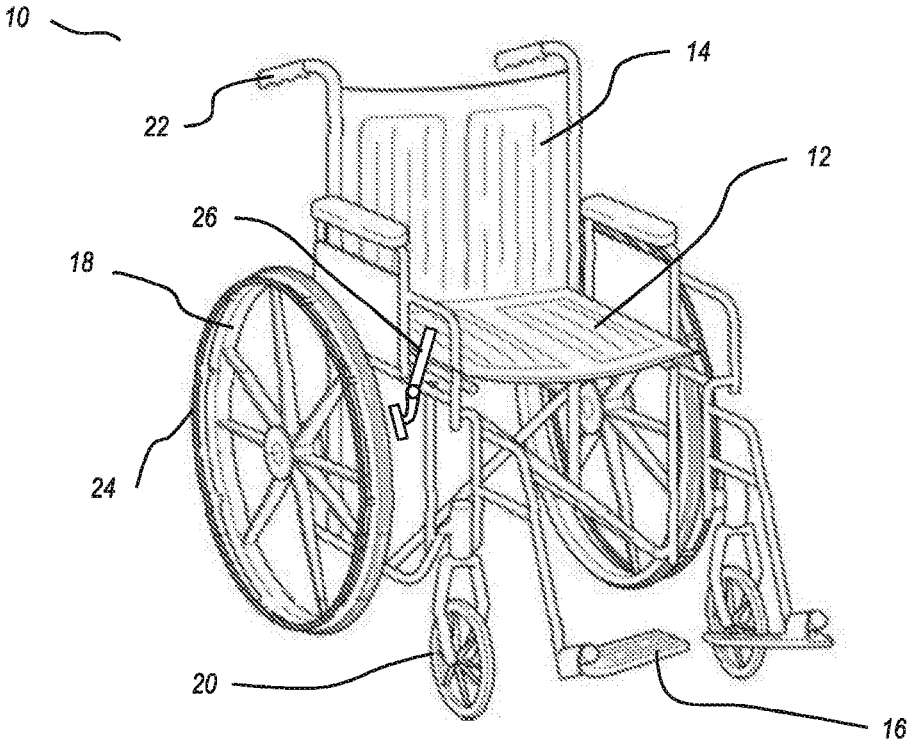
FIG. 1 illustrates a standard foldable manual wheelchair.

FIG. 1 illustrates a standard manual wheelchair 10. As shown, the wheelchair 10 includes a seat 12, backrest 14, footrests 16, rear wheels 18, front casters 20, and push handles 22. The rear wheels 18 are each connected to a corresponding pushrim 24, which may be grabbed by a user to propel and move the wheelchair. A pair of brakes 26 are also included. As shown, the brakes 26 are typically positioned on a portion of the frame underneath the seat 12 and in front of the corresponding rear wheel 18. The brakes 26 are operated by pushing or pulling a lever to bring the brake out of or into contact with the rear wheel 18.

Figure 2A:
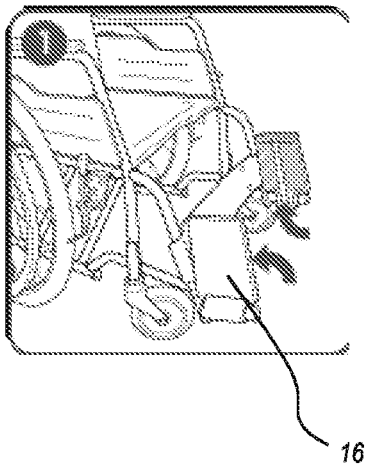
FIGS. 2A through 2C illustrate a typical folding procedure for a standard foldable manual wheelchair.
Figure 2B:
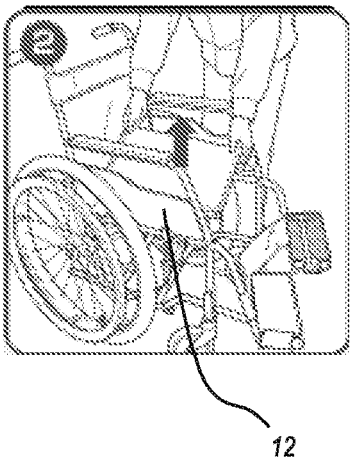
Figure 2C:
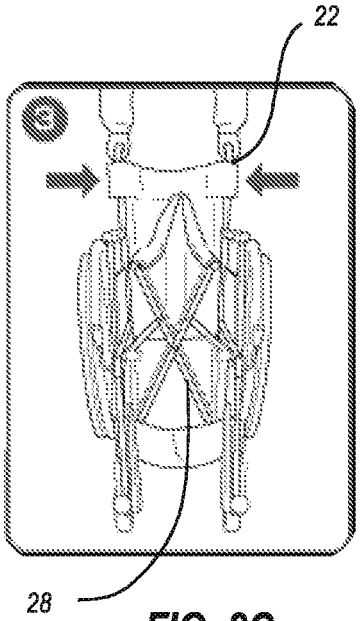

FIGS. 2A through 2C illustrate a typical process for folding a standard manual wheelchair. As shown, the footrests 16 are folded away from the center of the wheelchair. The seat 12 is then pulled upwards and/or the push handles 22 (or other portion of the outer frame) are pushed inwards to allow the wheelchair to collapse toward its center. The standard wheelchair 10 typically has a set of cross members 28 as part of the wheelchair frame when the wheelchair is in an unfolded configuration. These cross members 28 are often diagonally positioned to form an X-shape, as shown. The cross members 28 must be allowed to pivot and move without hindrance to allow the wheelchair to be adjusted to the folded configuration.

Figure 3A:
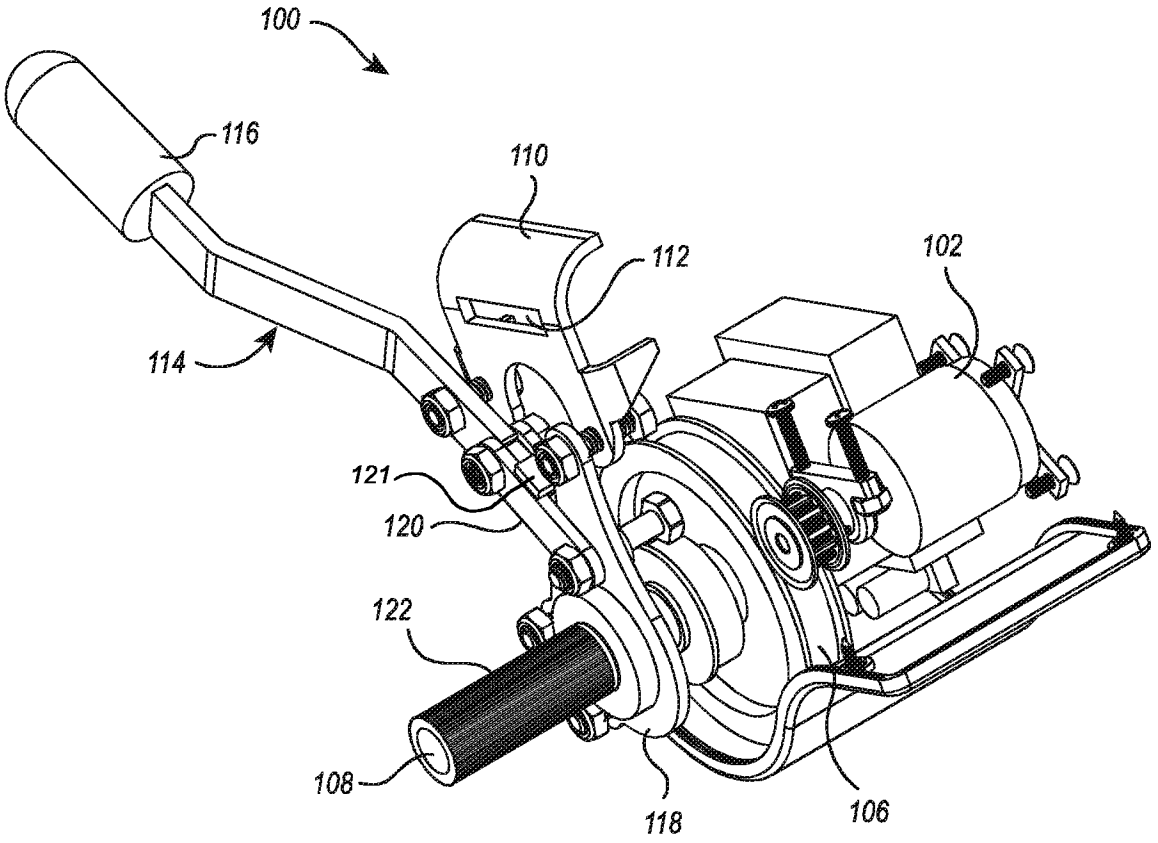
FIGS. 3A and 3B illustrate exemplary embodiments of a wheelchair upgrade device.

FIG. 3A illustrates an exemplary embodiment of a wheelchair upgrade device 100. The illustrated device 100 may be coupled to a suitable section of the frame of a receiving wheelchair and positioned to selectively provide motor-powered operation of the wheelchair. The device shown in FIG. 3 may be placed on one side of the receiving wheelchair (e.g., the left side) while another mirror-image version of the device is placed on the opposite side of the receiving wheelchair. Typically, both sides of the receiving wheelchair will be coupled to an upgrade device so that both wheels of the wheelchair will have the capability for selective motor-powered operation, though the embodiments described herein also include embodiments where only one side of a wheelchair is upgraded.

The illustrated embodiment includes an attachment mechanism to enable attachment of the device to a foldable wheelchair. The illustrated embodiment includes a coupling bracket 110 with a slotted section 112 to allow the use of fastening hardware (e.g., one or more screws, rivets, nuts and bolts, pins, etc.) to attach the coupling bracket 110 to a suitable portion of the wheelchair frame. Other embodiments may additionally or alternatively include one or more clamps, clasps, ties, friction fitting members, other fastening mechanisms, or combinations thereof. In some embodiments, the device 100 may be welded, adhered, or otherwise more permanently attached to the frame of the receiving wheelchair, though presently preferred embodiments are configured for detachable coupling to the receiving wheelchair.

Foldable wheelchairs will typically include one or more pre-existing holes or other receiving structures on a portion of the frame underneath the seat to allow attachment of braking components. Because the wheelchair upgrade device 100 is beneficially capable of providing braking functionality in addition to providing motorized power to the wheelchair, the standard brakes may be removed and the receiving holes/structures may be utilized for mounting of the upgrade device 100. Alternatively, if such receiving structures are not available on a particular wheelchair, a clamp-on (e.g., through lever lock clamp or screw-tightened clamp) attachment structure may be utilized.

Preferred upgrade device embodiments are configured to sufficiently attach to the receiving wheelchair at a single wheelchair frame member. For example, the illustrated device 100 is capable of being suspended at a position below the seat of the receiving wheelchair without requiring further underlying support or attachment to additional members of the wheelchair frame. The simple and effective coupling arrangement allows the device 100 to be properly positioned with minimal interference with the wheelchair frame and other wheelchair components, which in turn allows for ready folding and adjusting of the wheelchair without interference from the attached upgrade device. The illustrated embodiment is also capable of attachment to a foldable wheelchair without requiring the installation of additional wheelchair frame members.

The illustrated embodiment also includes a motor 102 operatively coupled to a roller member 108. As explained in more detail below, the roller member 108 is configured to be mechanically pressed against a corresponding tire of the receiving wheelchair. In such a position of contact, rotation of the roller member 108 drives rotation of the tire via the friction force between the roller member 108 and the contacted wheel. The roller member 108 is also able to function as a brake. For example, when the motor 102 is not driving rotation of the roller member 108, the roller member 108 can be contacted against the corresponding tire to slow and/or prevent rotation of the wheel. In this manner, the roller member 108 is able to function as both a means for transmitting power to the wheel and as a brake.

Figure 4:
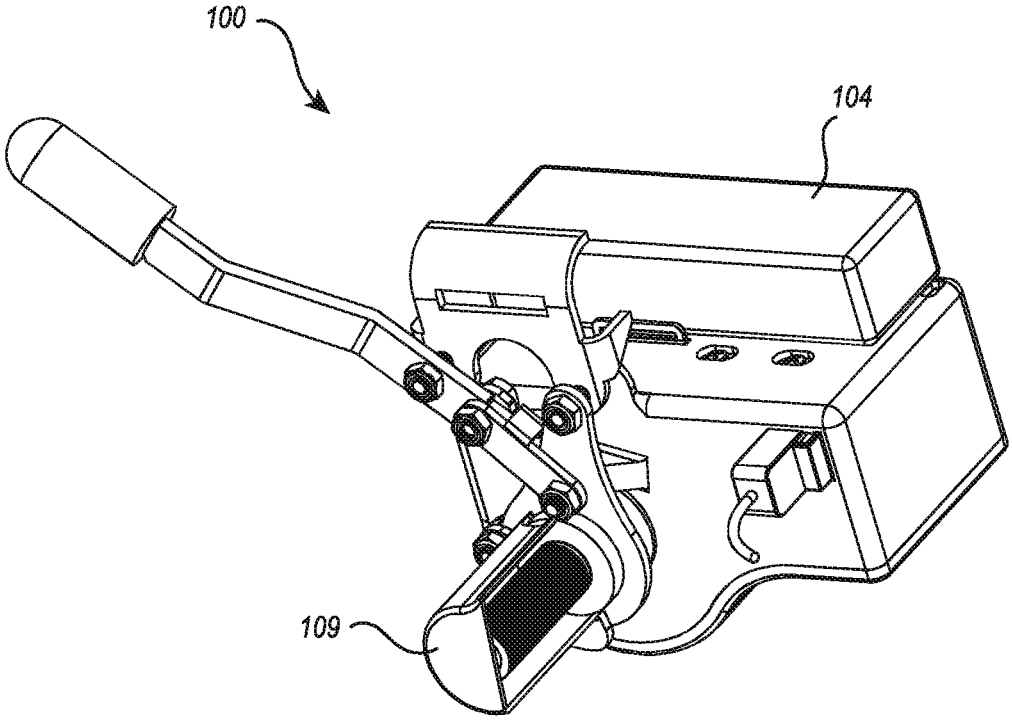
FIGS. 4 and 5 illustrate additional views of the wheelchair upgrade device, showing an encasement for housing the motor and drive assembly components and showing a protective cover surrounding the roller member.
Figure 5:
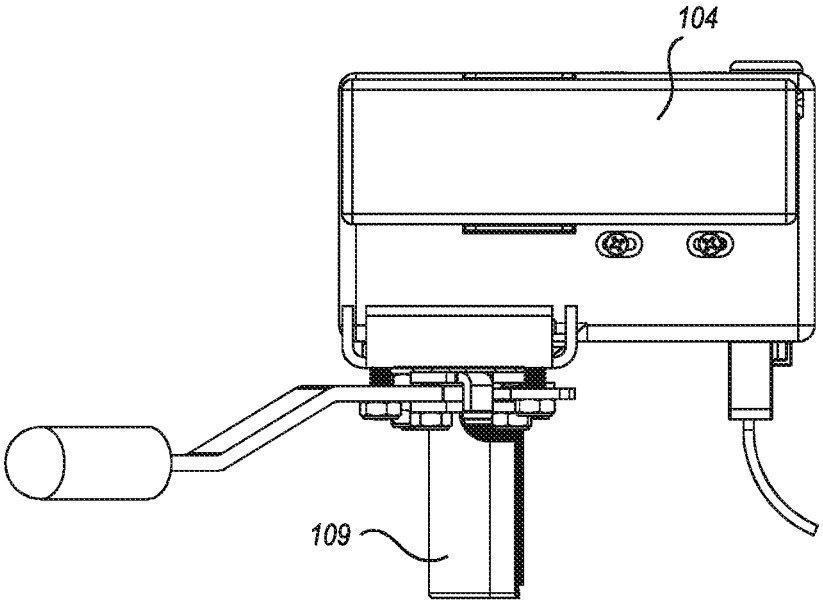

The illustrated device will typically include a motor housing 104 (see FIGS. 4 and 5). For clarity, the motor housing 104 is removed in this view to expose the interior motor and power transmission components. In some embodiments, the housing 104 is sealed to prevent unintentional contact with the interior components. In some embodiments, the motor housing 104 is sized to be compact and readily integrated with the receiving wheelchair. For example, the motor housing may have a width of about 2 to 5 inches, or about 3.5 inches, may have a length of about 3 to 7 inches, or about 5 inches, and a height/depth of about 2 to 5 inches, or about 3.5 inches. Thus, the motor housing may have a volume of about 45 to 85 cubic inches, or about 65 cubic inches.

The motor 102 may be any motor (or set of motors) of suitable power for driving rotation of the wheelchair wheel to which it is operatively coupled, or for at least assisting a user to make manual rotation of the wheel easier than in the absence of assistance from the motor 102. In presently preferred embodiments, the motor 102 is a brushless, high RPM motor. In one example, a suitable motor has a max power rating of 800 w, a Kv rating of 600 rpm/V, a max current of 54 A, a voltage rating of 14.8 v (4 s), an ESC of 80 A, and a no-load current of 0.6 A. It will be understood that other motors having other ratings may also be utilized according to preferences and particular application needs.

The illustrated embodiment includes a power transmission assembly 106 for transmitting power from the motor 102 to the roller member 108. The illustrated embodiment shows a series of pulleys to be fitted with a suitable belt. Alternative embodiments may additionally or alternatively include one or more gears, sprockets, tracks, rollers, racks (e.g., gear racks), worm gears, worms, clutches, universal joints, right-angle drives, bearings, gear boxes, and/or other power transmission components known in the art. In preferred embodiments, at least some of the components of the power transmission assembly 106 are formed from a lightweight material. For example, the pulleys (or the gears or other components as the case may be for a particular embodiment) may be formed from nylon or other suitable polymer material.

In the illustrated embodiment, the power transmission assembly is configured so that the shaft of the motor 102 is substantially parallel to the axis of the roller member 108. This arrangement provides effective power transmission to the roller member 108, and allows the motor 102 and roller member 108 to be positioned relative to one another in a manner that allows for compact and discreet integration of the device 100 with the receiving wheelchair. In particular, it has been found that in preferred embodiments utilizing relatively high RPM motors and relatively high gear ratios, aligning the motor shaft and the roller member 108 to be substantially parallel to one another (as opposed to a 90-degree offset, for example) enables effective operation of the device and propulsion of the contacted wheel.

The illustrated embodiment also includes an adjustment mechanism 114 operatively coupled to at least the roller member 108 to control movement of the roller member 108 toward or away from the corresponding wheelchair wheel. In the illustrated embodiment, the adjustment mechanism 114 includes links 120 disposed to form a kinematic change-point mechanism (see FIGS. 7B and 7C). Alternative embodiments may additionally or alternatively include other link elements, lever components, pivot attachments, limit pins, and/or other lever components known in the art. The adjustment mechanism 114 also includes a tab 121 for limiting the rotation of the link assembly too far beyond the change-point (when the links are approximately linearly aligned).

The illustrated adjustment mechanism 114 includes a lever 116 coupled to a roller member bracket 118. The roller member bracket 118 is rotationally attached to the mounting bracket 110 in a manner that allows the roller member bracket 118 to pivot relative to the mounting bracket 110. The roller member 108 passes through the roller member bracket 118 so that pivoting of the roller member bracket 118 also causes pivoting of the roller member 108 relative to the mounting bracket 110 (and relative to the wheelchair wheel).

In the illustrated embodiment, the roller member bracket 118 is rotationally linked to the motor housing 104 so that both the roller member bracket 118 and the motor housing 104 rotate together, along with the lever 116, when the lever 116 is adjusted. As shown, the motor 102 is positioned so that when the device 100 is coupled to a receiving wheelchair, the motor shaft is substantially horizontally oriented. The motor 102 is also positioned so that the motor shaft maintains the same angular tilt with respect to vertical and horizontal axes without respect to the position of the lever 116. For example, the motor shaft does not tilt upwards or downwards depending on whether the lever 116 is pushed forward or pulled back. This beneficially allows the device components to be positioned in a manner that allows for compact and discreet integration of the device 100 with the receiving wheelchair, and enables effective power transmission and propulsion of the contacted wheel.

The roller member 108 may be formed from any suitable material capable of providing sufficient friction contact with a corresponding wheelchair tire, such as a metal, polymer, or ceramic material. In preferred embodiments, the roller member 108 is formed from aluminum or an aluminum alloy. Such lightweight materials provide the roller member 108 with effective power transmission and braking capabilities while also being relatively lightweight. In an embodiment, the outer diameter surface of the roller member 108 may be etched or provided with a surface finish that increases the frictional forces so as to better apply torque to the outer perimeter of the tire of the wheelchair.

In some embodiments, the roller member 108 optionally includes a sleeve 122 disposed over at least a portion of the surface of the roller member 108. The sleeve 122 can beneficially minimize tire wear by acting as a sacrificial material that wears faster than the material of the wheelchair tire or about as fast as the material of the wheelchair tire. For example, the sleeve 122 may be formed from a rubber material, polyurethane, urethane, nylon, polyether block amide (PEBA), or other suitable polymer material. The sleeve 122 may also be fitted with a keyway, or a spring pin, or other locking mechanism so as to hold the sleeve rotationally fixed to the roller member 108. Preferably, the sleeve material has a durometer that is substantially equal to or lower than the durometer of the wheelchair tire. Typically, a wheelchair tire will be formed from rubber or urethane.

Figure 3B:
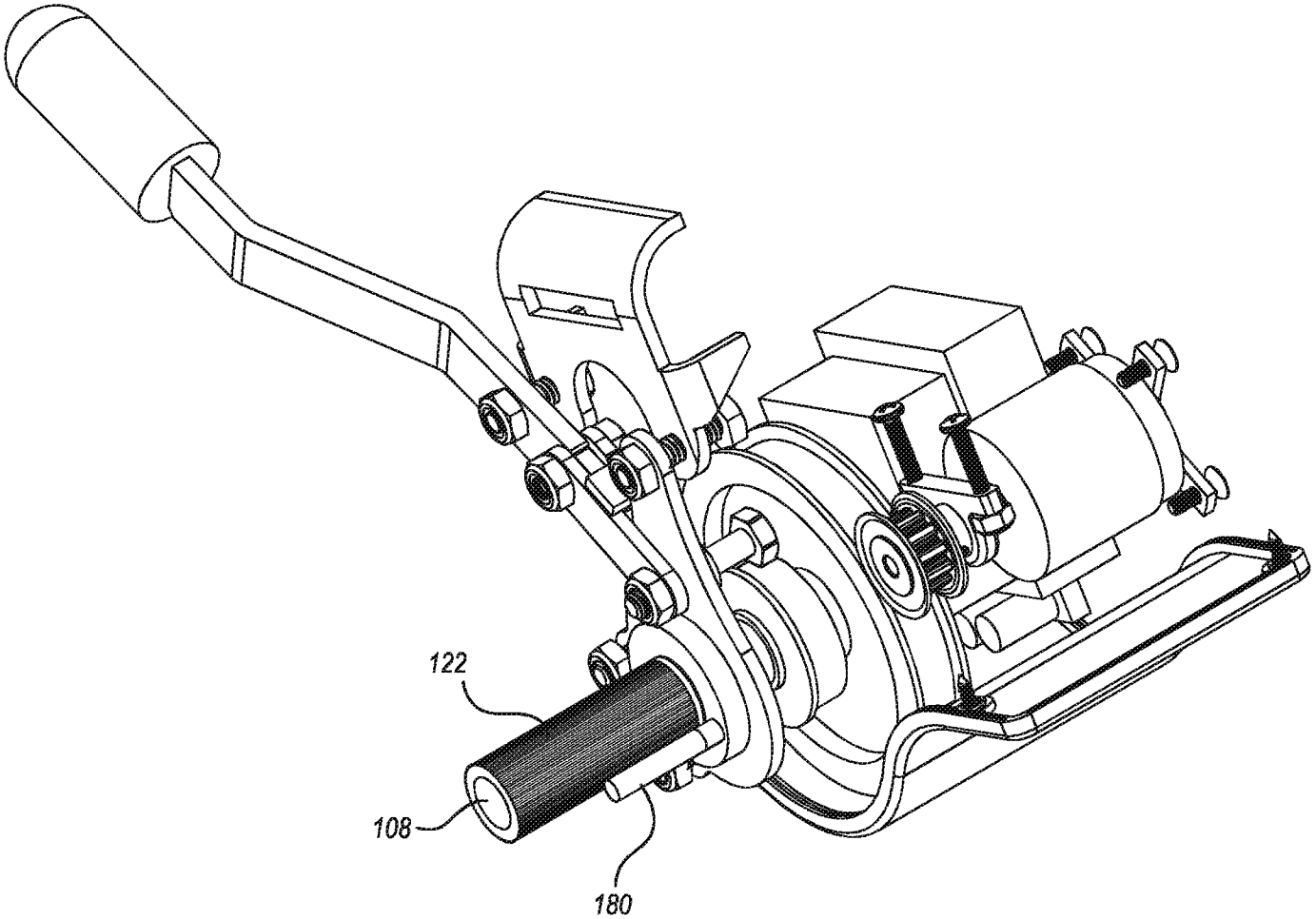

Some embodiments, such as shown in FIG. 3B, may also include a roller guard mechanism coupled to the roller member 108 for selectively impeding rotation of the roller member 108. In some embodiments, the sleeve 122 can function as the guard mechanism. A lever (e.g., lever clamp 180) can be operatively coupled to the guard mechanism so that when appropriately adjusted, the guard mechanism is forcefully pushed against the roller member 108 to prevent rotation, and to thereby also prevent movement of the wheelchair wheels.

The illustrated embodiment is configured to provide a high gear ratio between the wheelchair tire and the motor 102. In the illustrated embodiment, the motor shaft is geared up by a factor of 3. The roller member 108 has a diameter of approximately 1 inch. The ratio between the roller member 108 and a standard wheelchair wheel diameter (about 24 inches) is therefore about 24. The overall gear ratio between the wheelchair wheel and the motor 102 is therefore about 72:1.

Alternative embodiments may include different assemblies to achieve the same gear ratio, or may have different overall gear ratios. For example, the roller member 108 may be geared up relative to the motor shaft by a factor of 1, 2, 3, 4, 5, 7, 10, or a factor within a range with endpoints defined by any two of the foregoing values. The roller member 108 may have a diameter of about 0.5 inches, 0.75 inches, 1 inch, 1.25 inches, 1.5 inches, 2 inches, 3 inches, 4 inches, or a diameter within a range having endpoints defined by any two of the foregoing values. The overall gear ratio between the wheelchair wheel and the motor shaft may be about 6:1, 15:1, 30:1, 45:1, 60:1, 75:1, 90:1, 105:1, 120:1, or 135:1, for example.

Figure 6:
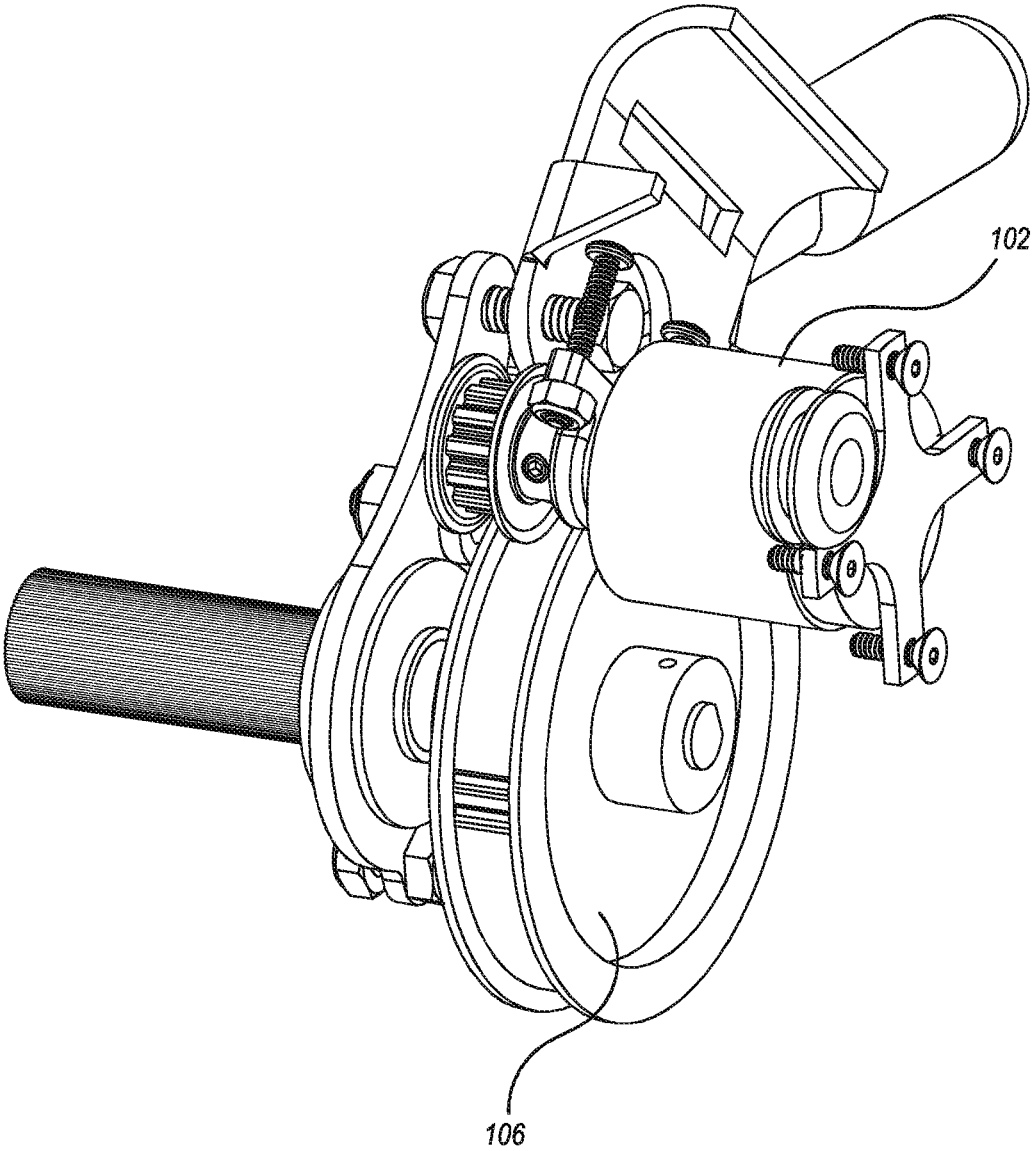
FIG. 6 illustrates another view of the wheelchair upgrade device showing the motor and other drive assembly components.

FIGS. 4 through 6 illustrate various views of the wheelchair upgrade device 100. FIGS. 4 and 5 show the housing 104 for housing the motor and other power transmission assembly components. The configuration shown in FIGS. 4 and 5 also includes a cover 109 configured to conceal the portions of the roller member 108 that do not need to be contacted against the wheelchair wheel. This can prevent accidental touching of an operating roller member 108 during operation of the device. FIG. 6 shows another view of the device 100 without the housing 104 to better illustrate the motor 102 and other components of the power transmission assembly 106.

Figure 7A:
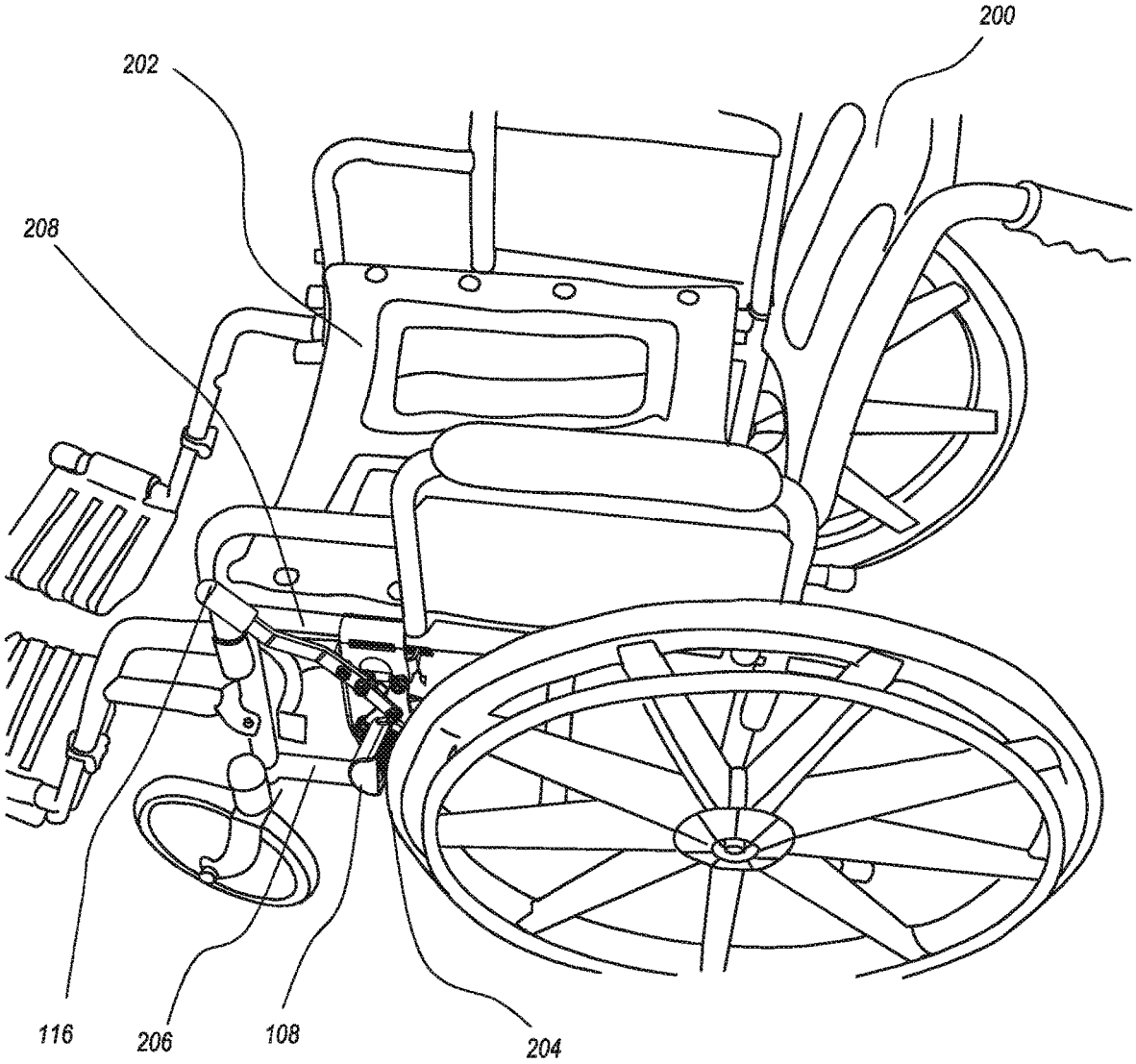
FIG. 7A through 7C illustrates the wheelchair upgrade device coupled to a foldable wheelchair, with FIG. 7B showing the device in a disengaged state and FIG. 7C showing the device in an engaged state.

FIG. 7A illustrates the upgrade device 100 coupled to a foldable wheelchair 200. Although the Figure shows the upgrade device 100 on only one side of the wheelchair 200, it will be understood that a mirror-image version of the upgrade device 100 may be coupled to the opposite side of the wheelchair as well to provide selective bimodal operation to both rear wheels of the wheelchair 200.

In the illustrated embodiment, the upgrade device 100 is coupled to the wheelchair frame so that the device is suspended below the seat 202 with the roller member 108 positioned in front of the corresponding wheel. In this preferred position, the upgrade device 100 is easily accessible to the wheelchair user while the user is seated in the wheelchair. The illustrated position of the upgrade device 100 is also where wheelchair brakes are commonly placed. The upgrade device 100 may therefore function as a replacement for the typical wheelchair braking mechanism. In some embodiments, the wheelchair omits any other braking components in the position of the upgrade device (e.g., omits any additional braking device attached to the same frame member as the upgrade device).

In addition, the wheelchair upgrade device 100 may be adjusted, attached to, or detached from the wheelchair frame while a user sits in a wheelchair, without the need for the user to move on and off of the wheelchair whenever an upgrade device 100 is adjusted, attached, or detached. The wheelchair upgrade device 100 is also capable of being attached and/or detached without requiring removal or adjustment of the wheelchair wheels, and without requiring added rims or added support frames on the wheelchair.

As explained above, the upgrade device 100 is capable of acting as both a brake and a source of motorized power. In the illustrated position, the lever 116 is in a pushed forward positon, bringing the roller member 108 into contact with the wheelchair tire 204. In this position, the upgrade device 100 can act as a brake (when the motor is not driving the roller member 108) or as the source of motorized power (when the motor drives rotation of the roller member 108). The lever 116 may be pulled back to move the roller member 108 away from the wheelchair tire 204, thereby allowing the wheelchair to be operated/propelled manually.

In alternative embodiments, an upgrade device may be positioned at other locations of the receiving wheelchair. For example, the upgrade device 100 may be suspended above a lower wheelchair frame member (such as frame member 206) instead of suspended below an upper (below the seat) wheelchair frame member 208, may be attached at or near an armrest 210 so as to be positioned above the wheelchair tire 204, or may be attached at or near a rear frame member 212 so as to contact a rearward portion of the wheelchair tire 204.

Although the exemplary illustrated embodiment includes a lever 116 for controlling adjustment of the device 100, alternative embodiments may additionally or alternatively include one or more knobs, grips, turn-dials, or other suitable controls capable of actuating mechanical adjustment of the other components of the upgrade device 100.

Figure 7B:
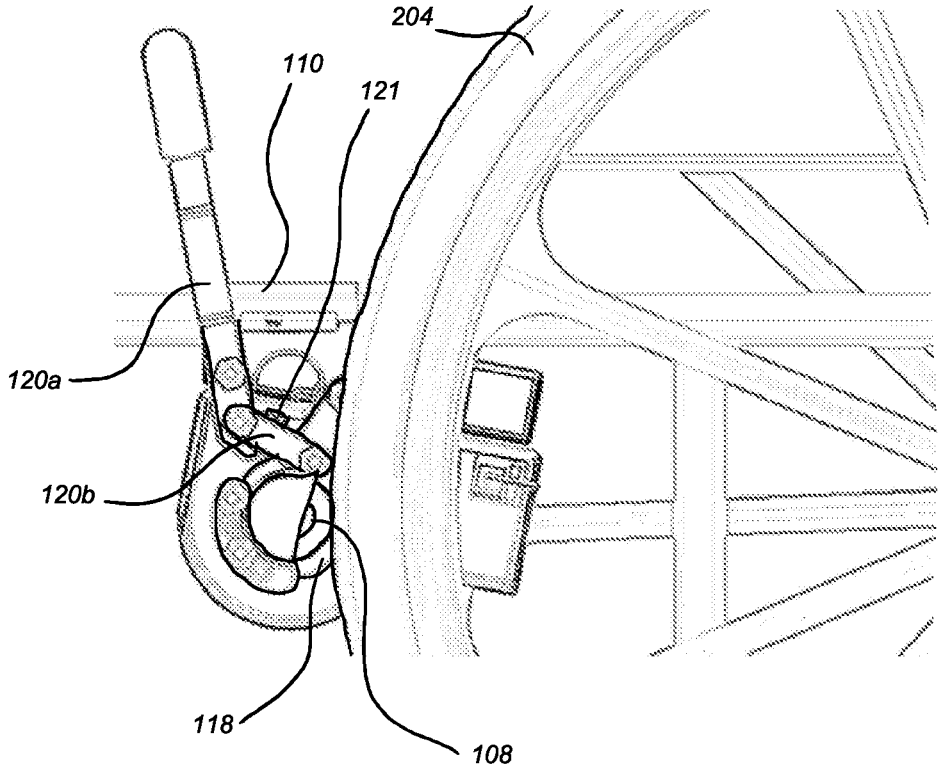
Figure 7C:
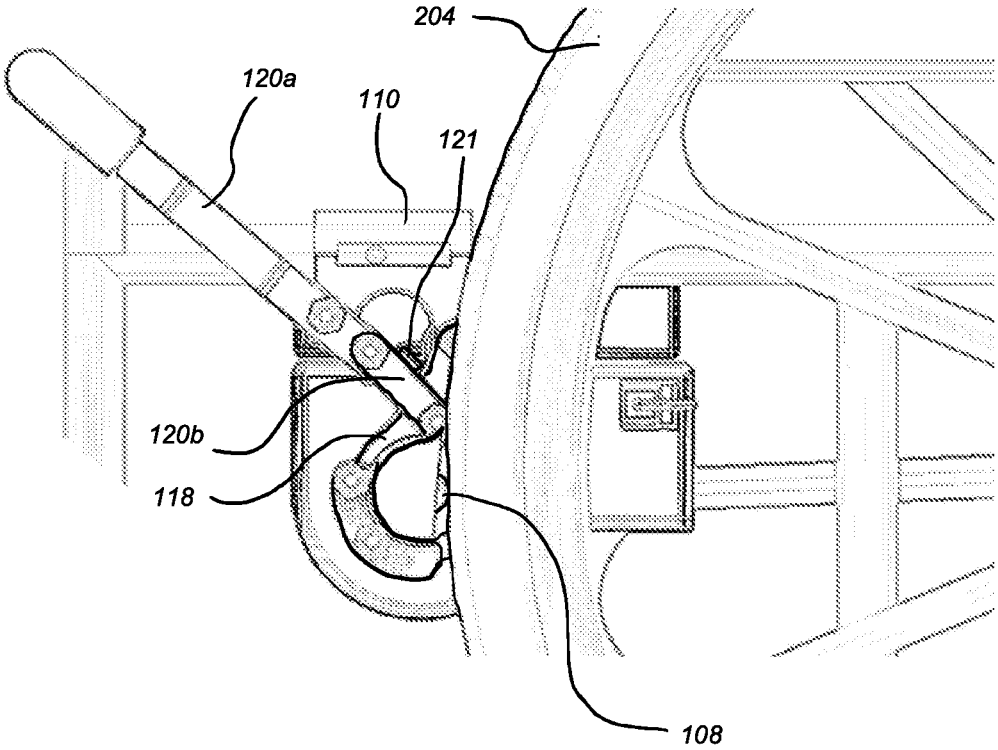

FIGS. 7B and 7C show side views of the device as it is coupled to a wheelchair, with FIG. 7B showing the device disengaged from the wheelchair wheel 204 and FIG. 7C showing the device engaged against the wheelchair wheel 204. As shown in FIG. 7B, the lever is pulled toward the user, which puts link members 120*a* and 120*b* out of linear alignment. This rotates the motor housing and roller member bracket 118 in a position where the roller 108 is disengaged from the wheelchair wheel 204. When the lever is pushed forward to the position shown in FIG. 7C, the links 120*a* and 120*b* are brought into greater linear alignment. This causes the motor housing and the roller member bracket 118 to rotate relative to the coupling bracket 110 and thereby engage against the wheelchair wheel 204.

In the engaged position, the lever may be positioned to place the link assembly just past the change-point. For example, when pushing the lever forward from the disengaged position of FIG. 7B to toward the engaged position of FIG. 7C, the link members 120*a* and 120*b* are brought to the change point where they are substantially linear. At this point the roller 108 is pressed against the wheelchair wheel 204 with maximum force. A slight amount of additional pushing of the lever puts the link members 120*a* and 120*b* just past the change point on the other side, to where they are just slightly out of alignment as shown in FIG. 7C. This beneficially keeps the device in a firm engaged state against the wheelchair wheel 204 while also minimizing risk of unintentionally slipping out of engagement. The stop tab 121 limits the link assembly from being pushed too far past the change point when the lever is pressed forward. The stop tab 121 also provides structure for rotating link member 120*b* when the lever is pulled back toward the user.

Figure 8:
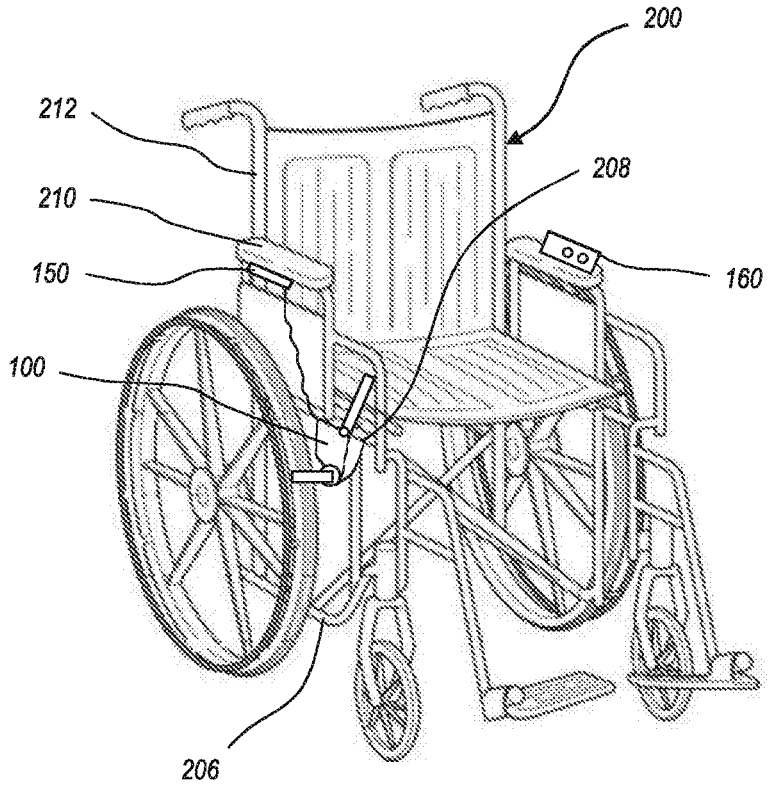
FIG. 8 illustrates a wheelchair upgrade system integrated with a foldable wheelchair, transforming the wheelchair into a hybrid wheelchair capable of selective bimodal operation.

FIG. 8 illustrates a foldable wheelchair 200 showing an exemplary wheelchair upgrade system integrated with the foldable wheelchair 200. As shown, the upgrade device 100 is attached at the exemplary position shown in FIG. 7. A battery 150 is positioned underneath the arm rest 210 and is wired or otherwise operatively coupled to the motor of the upgrade device 100 (and optionally to the controller 160 as well). The battery 150 may alternatively be positioned at other locations. For example, the battery 150 may be positioned underneath the seat 202 and/or may be directly connected to the upgrade device 100 (e.g., on the motor housing). In some embodiments, the battery 150 may be attached to a frame member of the wheelchair, such as lower frame member 206, upper frame member 208, or rear frame member 212. Preferably, however, the location of the battery 150 is selected so as not to interfere with folding of the wheelchair 200.

The battery 150 may be any battery or other power source capable of providing sufficient power to the motor of the upgrade device 100. In presently preferred embodiments, the battery 150 is a lithium-ion polymer battery, which provides effective power with relatively little added weight. The battery 150 may also be sized as needed to provide desired levels of power, though preferred battery sizes are small enough to avoid interference with folding of the wheelchair. In one embodiment, the battery 150 has a size of about 5.5 inches by 1.75 inches by 1.0 inch. Although a single battery 150 is shown, it will be understood that multiple batteries may also be utilized to provide power to the motor(s) of the upgrade device(s). It will be understood that other types and/or sizes of batteries may be utilized according to particular application needs or preferences.

The illustrated upgrade system also includes a controller 160 that is communicatively linked to the motor of the upgrade device 100. The controller can include one or more joystick, directional paddle, button assembly, accelerometer device, and/or other manipulatable device capable of receiving inputs from the wheelchair user. The controller 160 may be directly wired to the upgrade device 100 or may be wirelessly linked (e.g., via Bluetooth, infrared signal, and/or other suitable connection). The controller 160 sends received input to the motor of the upgrade device 100 to control at least the rotation speed of the roller member, thereby controlling the movement of the contacted wheel. The controller 160 may be attached to the wheelchair or may be a separate, detached component. In embodiments in which it is attached, it may be attached to an arm rest, to a portion of the frame, or to another suitable location where a user can readily reach the controller. In preferred embodiments, the controller 160 is not attached to, and can be moved relative to, the levers of the upgrade device, allowing a user to completely let go of the levers to use the controller 160 to control the wheelchair speed and direction. In some applications, the controller 160 may be positioned on a handle of the wheelchair, or the controller 160 may be held by a person walking behind the chair, so that the person behind the chair can control operation of the device and movement of the chair. Alternatively, if capable, the person occupying the chair may hold and operate the controller 160.

In some embodiments, the wheelchair upgrade system is configured with lightweight components so as to minimize the weight added to the receiving wheelchair. In preferred embodiments, the total weight of the upgrade system (including two upgrade devices—one on each side of the wheelchair) is less than about 40 pounds, less than about 30 pounds, or even less than about 20 pounds. For example, a presently preferred embodiment of a system with two upgrade devices has a weight of about 8 to 15 pounds (including battery, controllers, motors, housing, and power transmission components). Despite the relatively lightweight construction, the upgrade system is capable of propelling a wheelchair at over 5 miles per hour while supporting a user with a weight of about 200 pounds.

These low weight embodiments minimize any negative effects of integrating the upgrade system with a foldable wheelchair, and allow the upgraded wheelchair to maintain its previous benefits of being relatively lightweight and easy to move, store, transport, etcetera. Further, because the upgrade device 100 may function as a brake replacement, standard brake components are not necessary and may be removed, making the net weight gain from integrating the upgrade device 100 even lower.

Figure 9:
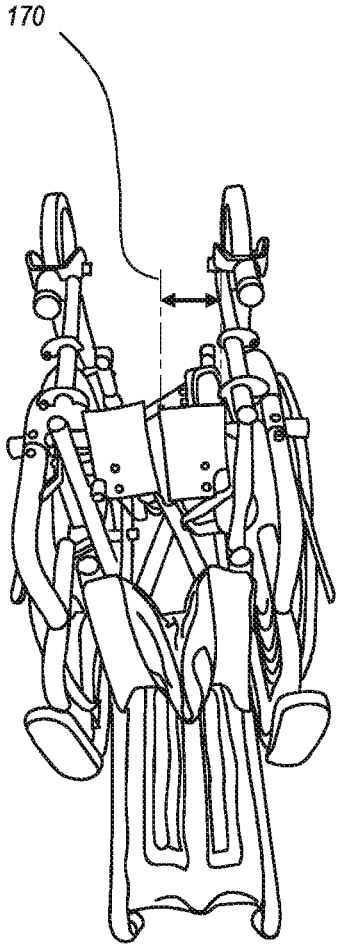
FIG. 9 illustrates a foldable wheelchair with which the wheelchair upgrade system has been integrated successfully folded without detaching the wheelchair upgrade system.

FIG. 9 illustrates a wheelchair and attached wheelchair upgrade system in a folded position. As shown, the wheelchair may be folded without the need to detach or readjust the wheelchair upgrade system. FIG. 9 also shows the importance of providing the upgrade devices in a size and attachment position that allows proper folding of the associated wheelchair. For example, the interior width of the device (the width of the portion of the device located interior to the frame when the device is attached; shown here by reference numeral 170) is preferably about 2 to 5 inches wide, or less than about 4 inches wide. The folded wheelchair can beneficially be placed in a standard car trunk, enabling storage and transport of the wheelchair without requiring removal of the upgrade system.

Although the foregoing has been described in some detail by way of illustrations and examples for purposes of clarity and understanding, it will be understood by those of skill in the art that numerous and various modifications can be made without departing from the spirit of the present disclosure. Therefore, it should be clearly understood that the forms disclosed herein are illustrative only and are not intended to limit the scope of the present disclosure, but rather to also cover all modification and alternatives coming with the true scope and spirit of the invention.

The invention claimed is:

1. A wheelchair powering device configured for integration with a foldable wheelchair, the device comprising:

an attachment mechanism configured to attach the powering device to the foldable wheelchair at a section of a frame of the foldable wheelchair having a pre-existing standard receiving structure, the standard receiving structure being configured to receive a standard braking component, the attachment mechanism being configured and shaped to attach the power device to the frame of the foldable wheelchair device at the standard receiving structure or at the standard braking component;

a motor;

a roller member operatively coupled to the motor such that operation of the motor drives rotation of the roller member; and an adjustment mechanism operatively coupled to the roller member, the adjustment mechanism being configured to control movement of the roller member into and out of contact with a wheel of the wheelchair to enable selective powered operation of the wheelchair, wherein the wheelchair powering device is configured to allow the wheelchair to be folded while the wheelchair powering device is attached to the foldable wheelchair.

2. The wheelchair powering device of claim 1, wherein the pre-existing standard receiving structure includes at least one receiving hole.

3. The wheelchair powering device of claim 1, wherein the wheelchair powering device is configured to provide a breaking operation to the wheelchair.

4. The wheelchair powering device of claim 1, wherein the attachment mechanism includes a coupling bracket configured to interface with the receiving structure of the frame of the wheelchair.

5. The wheelchair powering device of claim 1, wherein the section of the frame of the foldable wheelchair having the pre-existing braking component receiving structure is disposed below a seat of the foldable wheelchair.

6. The wheelchair powering device of claim 1, further comprising a power transmission assembly to transmit power between the motor and the roller member, the power transmission assembly including a gear train.

7. The wheelchair powering device of claim 1, further comprising a power transmission assembly to transmit power between the motor and the roller member, the power transmission assembly including a worm gear assembly, the worm gear assembly being configured to provide frictional locking when a motor shaft of the motor is not rotating so as to allow the roller member to act as a brake.

8. The wheelchair powering device of claim 1, wherein the adjustment mechanism includes a lever.

9. The wheelchair powering device of claim 8, wherein the roller member passes through a roller member bracket, and wherein the lever is operatively coupled to the roller member bracket such that adjustment of the lever causes rotation of the roller member bracket to displace the roller member.

10. The wheelchair powering device of claim 9, wherein the motor is at least partially disposed within a motor housing, and wherein the motor housing is rotationally linked to the roller member bracket.

11. The wheelchair powering device of claim 1, wherein the motor is positioned relative to the attachment mechanism so that, upon attachment of the powering device to the foldable wheelchair, a shaft of the motor is substantially horizontally oriented.

12. The wheelchair powering device of claim 1, wherein the motor includes a shaft, the shaft being aligned substantially perpendicular to an axis of the roller member.

13. The wheelchair powering device of claim 1, further comprising a sleeve disposed around at least a portion of the roller member to provide wear protection to a contacted tire of the foldable wheelchair.

14. The wheelchair powering device of claim 13, wherein the sleeve is formed from a polymer material.

15. A wheelchair system comprising:

a foldable wheelchair having a frame, wherein a section of the frame incudes a receiving structure configured to receive a standard braking component; and a wheelchair powering system integrated with the foldable wheelchair, the wheelchair power system including a first wheelchair powering device, wherein the first wheelchair powering device includes an attachment mechanism that attaches the first powering device to the wheelchair at the receiving structure configured to receive the standard braking component or at the standard braking component;

a motor;

a roller member operatively coupled to the motor such that operation of the motor drives rotation of the roller member; and an adjustment mechanism operatively coupled to the roller member, the adjustment mechanism being configured to control movement of the roller member into and out of contact with a wheel of the wheelchair to enable selective powered operation of the wheelchair, wherein the wheelchair remains foldable with the first wheelchair powering device attached to the foldable wheelchair.

16. The system of claim 15, wherein the attachment mechanism includes a coupling bracket configured to interface with the receiving structure of the frame of the wheelchair.

17. The system of claim 15, wherein the section of the frame of the foldable wheelchair including the receiving structure is disposed underneath a seat of the foldable wheelchair.

18. The system of claim 15, further comprising:

a battery operatively coupled to the motor of the first wheelchair powering device; and a controller communicatively linked to the motor of the first wheelchair powering device to provide control over the motor.

19. The system of claim 15, further comprising a second wheelchair powering device, wherein the second wheelchair powering device includes:

an attachment mechanism that attaches the second powering device to the wheelchair at the receiving structure;

a motor;

a roller member operatively coupled to the motor such that operation of the motor drives rotation of the roller member; and an adjustment mechanism operatively coupled to the roller member, the adjustment mechanism being configured to control movement of the roller member into and out of contact with a wheel of the wheelchair to enable selective powered operation of the wheelchair, wherein the wheelchair remains foldable with both the first and second wheelchair powering devices attached to the foldable wheelchair.

20. A method for upgrading a manually-powered foldable wheelchair, the method comprising:

providing a foldable wheelchair, the foldable wheelchair having a frame that includes a receiving structure positioned for receiving a braking component;

providing a wheelchair powering device, the wheelchair powering device including an attachment mechanism configured to attach the powering device to the wheelchair at the receiving structure or at the standard braking component, a motor, a roller member operatively coupled to the motor such that operation of the motor drives rotation of the roller member, and an adjustment mechanism operatively coupled to the roller member, the adjustment mechanism being configured to control movement of the roller member into and out of contact with a wheel of the wheelchair, integrating the wheelchair powering device with the foldable wheelchair by attaching the attachment mechanism to a section of the frame that includes the receiving structure.

* * * * *